US010644449B2

(12) United States Patent
Iida

(10) Patent No.: US 10,644,449 B2
(45) Date of Patent: May 5, 2020

(54) CONNECTOR WITH LOCK ARM

(71) Applicant: Sumitomo Wiring Systems, Ltd., Yokkaichi, Mie (JP)

(72) Inventor: Koji Iida, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/292,870

(22) Filed: Mar. 5, 2019

(65) Prior Publication Data

US 2019/0296487 A1 Sep. 26, 2019

(30) Foreign Application Priority Data

Mar. 22, 2018 (JP) ..... 2018-054888

(51) Int. Cl.
*H01R 13/639* (2006.01)

(52) U.S. Cl.
CPC ..... *H01R 13/639* (2013.01)

(58) Field of Classification Search
CPC ..... H01R 13/639; H01R 13/40
USPC ..... 439/357, 345
See application file for complete search history.

(56) References Cited

U.S. PATENT DOCUMENTS 5,203,719 A * 4/1993 Kozono ..... H01R 13/6272 439/357
2001/0046803 A1* 11/2001 Kodama ..... H01R 13/6273 439/357
2002/0072265 A1* 6/2002 Chen ..... H01R 13/6272 439/357
2005/0247476 A1* 11/2005 Aihara ..... H01R 13/6272 174/50.52

FOREIGN PATENT DOCUMENTS

JP 2005-302602 10/2001

* cited by examiner

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A female connector (10) includes a housing body (20). A lock arm (30) has a front end coupled to the housing body (20) and extends rearward. Two legs (80) laterally support the lock arm (30). The lock arm (30) includes an arm body (40) having a lock claw (60) behind a base end (41) and can lock to a mating connector (100) by resiliently returning upward. An unlocking portion (50) is at a rear end of the arm body (40) for displacing the arm body (40) down. An interlocking support (81) extends laterally from the unlocking portion (50) above the housing body (20) and an independent support (82) is separated from the lock arm (30) above the housing body (20), extends in a front-rear direction and has one end coupled to the interlocking support (81) and the other end coupled to the housing body (82).

3 Claims, 11 Drawing Sheets

CONNECTOR WITH LOCK ARM

BACKGROUND

Field of the Invention

This specification relates to a connector.

Related Art

Japanese Unexamined Patent Publication No. 2005-302602 discloses a connector with a lock to be locked to a mating housing. In this connector, a lock arm provided on a female connector includes an arm body, an unlocking portion provided perpendicularly on a rear end of the arm body and arms projecting obliquely down on both sides of the unlocking portion. The lock arm is folded rearward from the front edge of a female housing and the arms are coupled to protection walls so that the lock arm has a three-point supporting structure. A lock is provided substantially in a center of the arm body in a length direction and is to be locked to a lock of a male housing. Further, restricting walls are provided on the protection walls and are disposed above the arms to restrict inadvertent contact of a worker with the arms.

To separate the female connector from a male connector, a pressing portion of the unlocking portion is pressed with a finger. Thus, the unlocking portion is pressed down while resiliently deforming the arms. Associated with that, the arm body is swung down so that the lock is disengaged downward from the locked portion to release locking.

However, the pressing portion serving as a point of force during an unlocking operation is wide in a front-rear direction on the rear end of the arm body to ensure a finger placing area. Thus, a distance to the lock serving as a point of action is relatively short and, accordingly, an unlocking force is large. To reduce the unlocking force in this configuration, it is considered to thin the arm body and a leg or to narrow the leg. However, in that case, resilient return forces of the arm body and the leg and a supporting force of the leg to support the arm body also are reduced. Therefore, a desired locking force may not be obtained.

SUMMARY

A connector according to this specification includes a housing body to which a mating connector is to be fit from the front. A lock arm has a front end coupled to the housing body and extends rearward, and two legs laterally support the lock arm. The lock arm includes an arm body having a lock provided behind a base end part and to be locked to the mating connector by resiliently returning upward. An unlocking portion is coupled to a rear end of the arm body and is capable of displacing the arm body down by being displaced down. The leg includes an interlocking support extending laterally from the unlocking portion above the housing body and an independent support separated from the lock arm above the housing body. The support extends in a front-rear direction and has one end coupled to the interlocking support and the other end coupled to the housing body.

According to this configuration, the lock arm is supported on three points by the base end part and the two legs when locking the connector to the mating connector. Thus, a locking force for the mating connector can be ensured.

Further, when detaching the connector from the mating connector, even if the unlocking portion is displaced down to displace the lock arm down, the independent supports are not interlocked with a downward displacement of the lock arm due to separation from the lock arm. Thus, the lock arm can be displaced down independently of the independent supports while the interlocking supports are deflected. Specifically, since a pressing force for pressing and displacing the independent supports downward decreases, an unlocking force can be reduced.

Further, the interlocking supports are disposed above the housing body and contact the housing body when displaced down. In this way, excessive deflection of the lock arm can be prevented.

The interlocking support is coupled to a rear end of the unlocking portion and the independent support portion extends forward from the interlocking support portion.

According to this configuration, the lock arm is entirely within a three-point supporting range by the interlocking support portions and the base end part in a length direction. Thus, the locking force for the mating connector can be ensured.

Cutout recesses open forward or rearward are formed by the lock arm, the interlocking supports and the independent supports. According to this configuration, the interlocking supports are thinned by the cutout recesses, and the lock arm is deflected easily when being displaced down. Specifically, since a deforming force for deflecting the interlocking supports decreases, the unlocking force can be reduced.

According to the connector relating to this specification, an unlocking force can be reduced while a locking force for the mating connector is ensured.

DETAILED DESCRIPTION

A first embodiment is described with reference to FIGS. 1 to 10.

Figure 1:
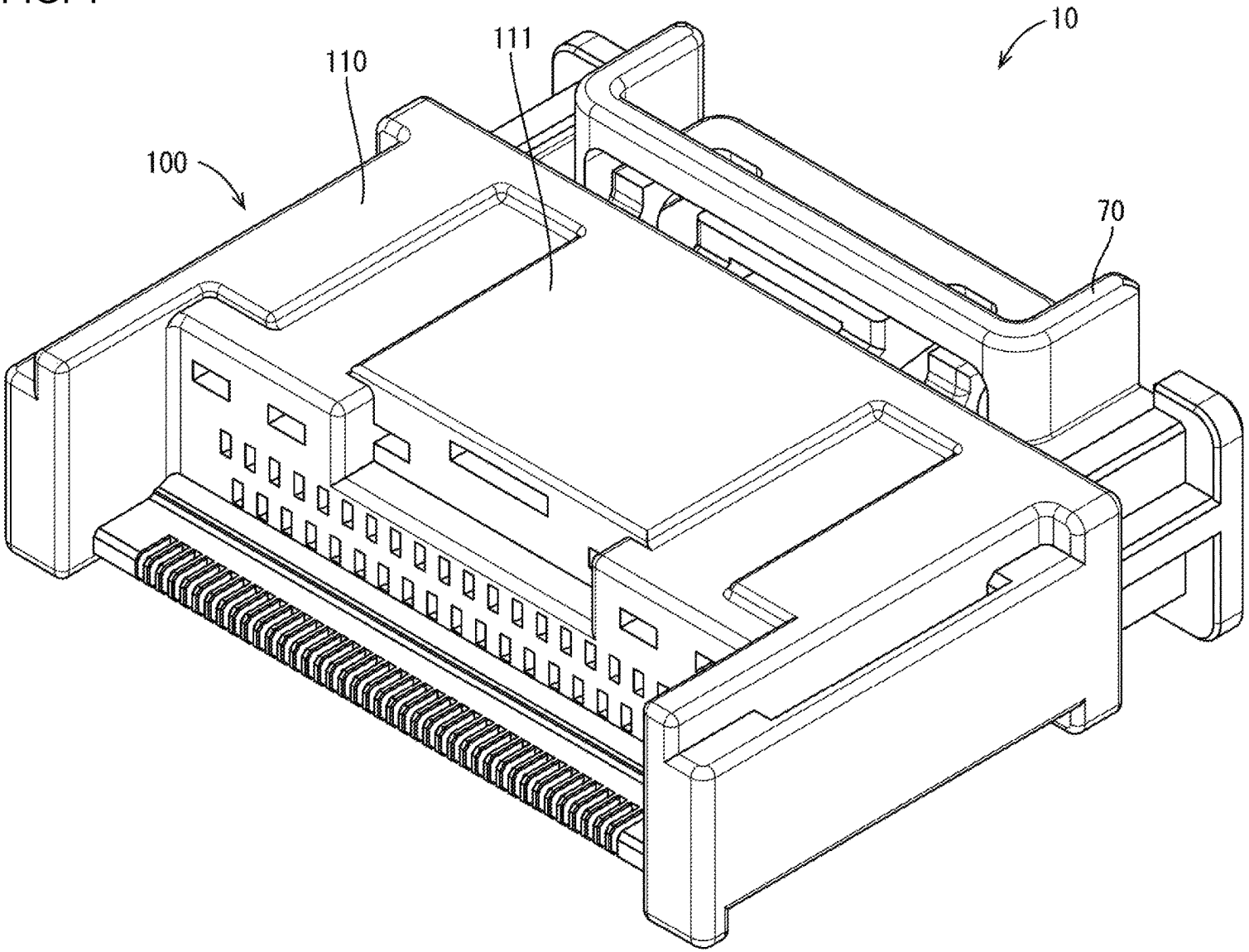
FIG. 1 is a perspective view showing a state where a female connector (connector) of an embodiment is connected to a mating connector.
Figure 2:
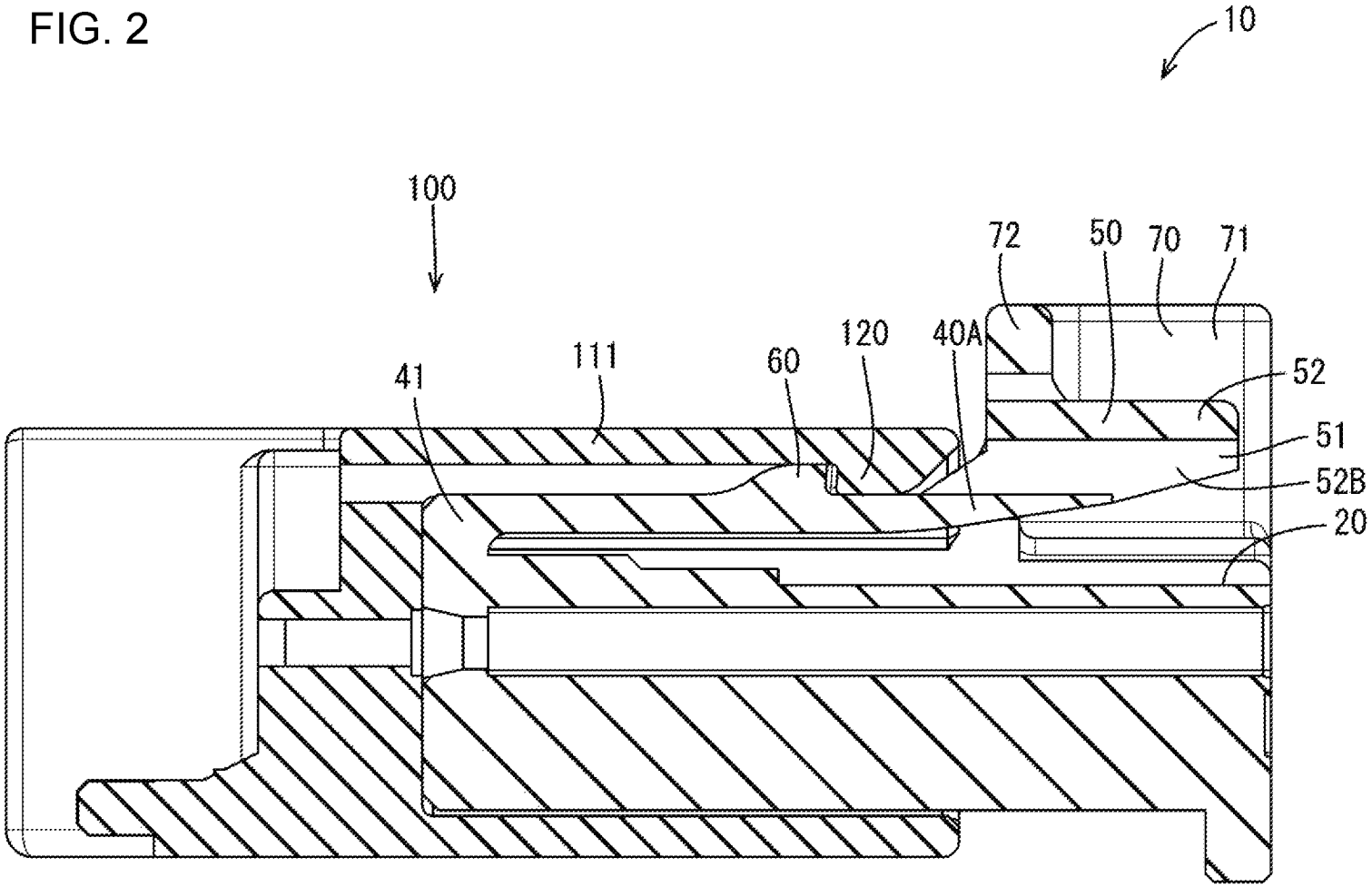
FIG. 2 is a longitudinal section in the state where the female connector is connected to the mating connector.

A connector 10 of this embodiment is a female connector 10 with unillustrated female terminals and, as shown in FIGS. 1 and 2, electrically connected to unillustrated male terminals in a mating connector 100 by being fit into the mating connector 100. In the following description, connecting directions facing each other are referred to as forward directions in the mating connector 100 and the female connector 10. Further, a vertical direction is based on a vertical direction in FIG. 1.

(Mating Connector 100)

As shown in FIG. 1, the mating connector 100 includes a receptacle 110 in the form of a forwardly open rectangular tube. As shown in FIG. 2, a lock receiving portion 120 is provided on a ceiling wall 111 of the receptacle 110 and projects down. The rear end of the lock receiving portion 120 is a vertically flat surface and the front end thereof is a tapered shape having a lower surface inclined up toward the front.

(Female Connector 10)

Figure 3:
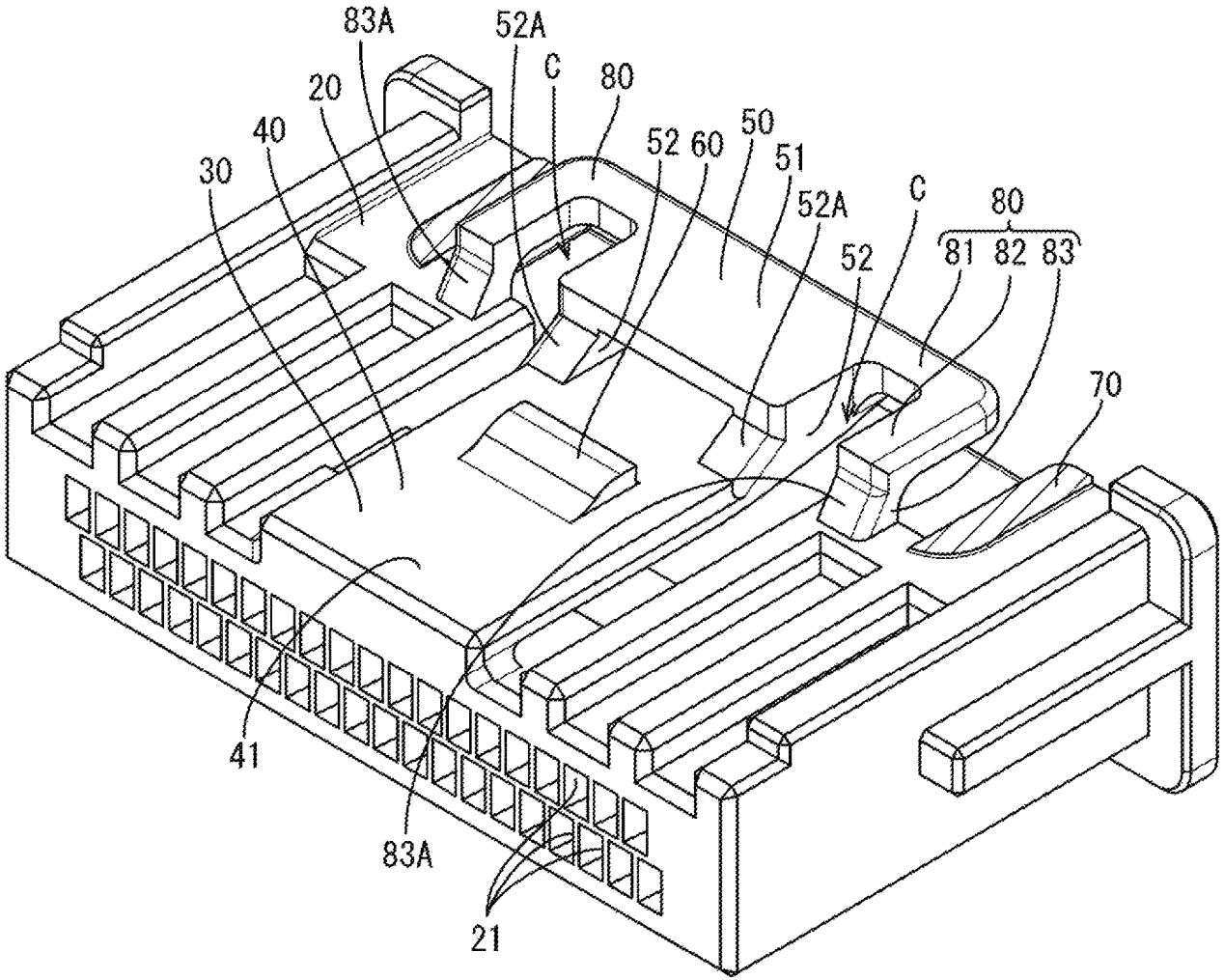
FIG. 3 is a perspective view of the connector viewed from front with protection walls omitted.
Figure 4:
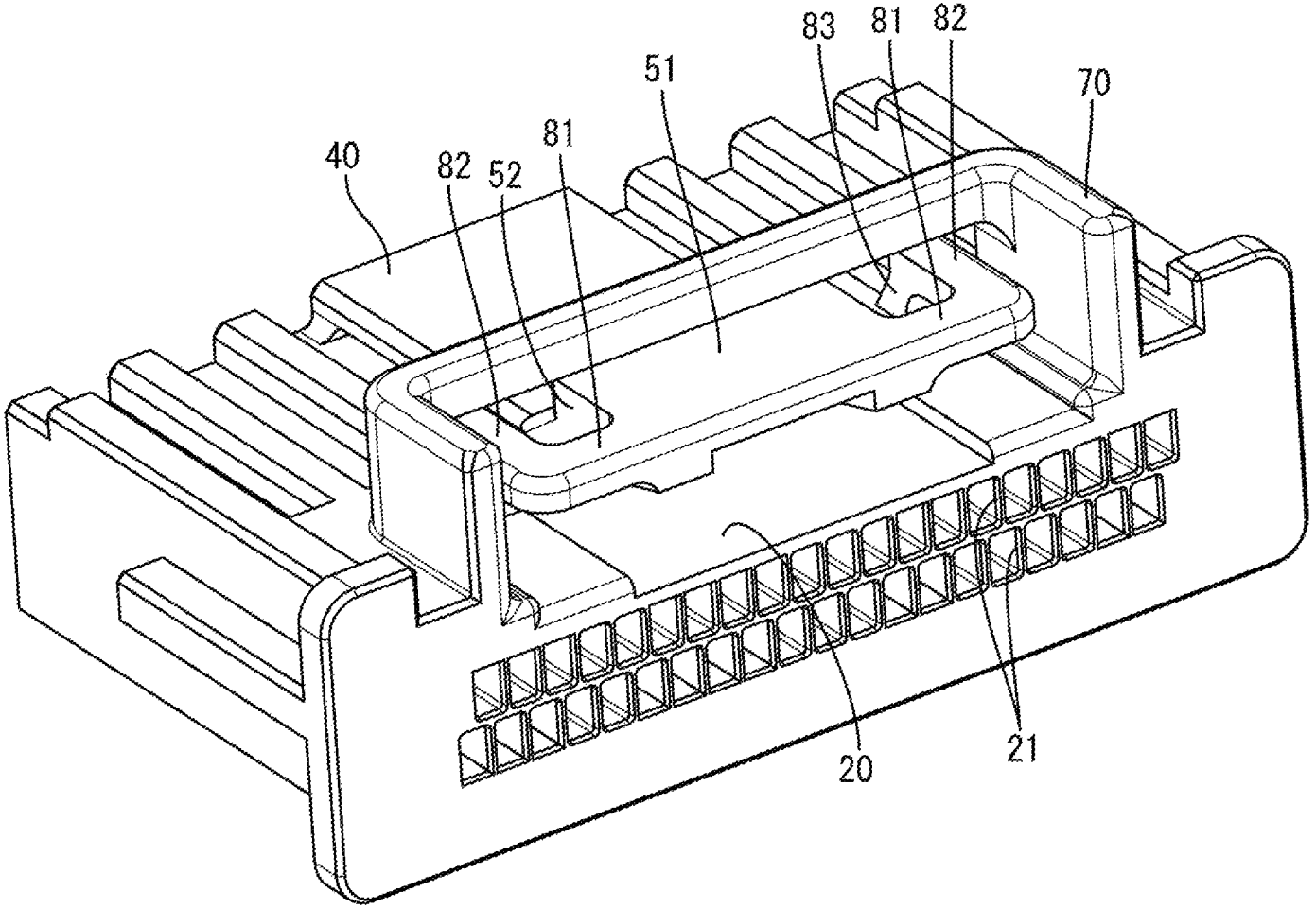
FIG. 4 is a perspective view of the connector viewed from behind.
Figure 5:
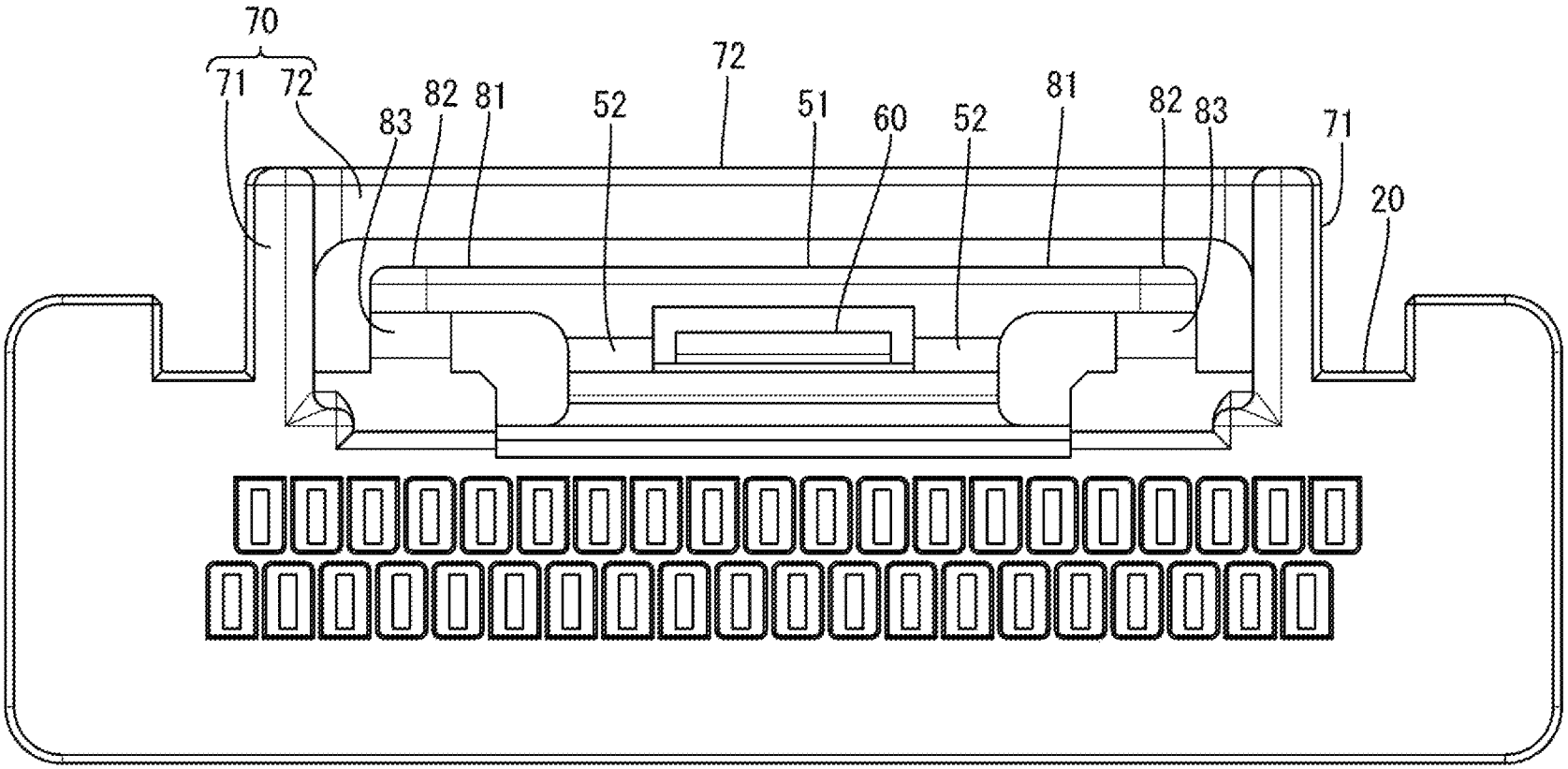
FIG. 5 is a front view of the connector.

As shown in FIG. 3, the female connector 10 has a substantially rectangular parallelepiped shape and includes a housing body 20. The housing body 20 has a front end to be accommodated in the receptacle 110, a lock arm 30 to be locked to the receptacle 110, two legs 80 laterally supporting the lock arm 30 from left and right sides, and a lock protecting portion 70 for preventing a lock from being pressed inadvertently, as shown in FIG. 1. As shown in FIGS. 3 and 4, cavities 21 are provided inside the housing body 20 to open forward and rearward. An unillustrated female terminal is accommodated in each cavity 21.

(Lock Arm 30)

As shown in FIG. 3, the lock arm 30 is composed of an arm body 40 and an unlocking portion 50 coupled to the rear end of the arm body 40.

The arm body 40 is a strip including a base end part 41 rising up from the front end of the housing body 20 and extending rearward from the base end 41. As shown in FIG. 2, a rear end of the arm body 40 is formed into a contacting tapered portion 40A having a lower surface gently inclined up toward the rear end. A lock claw 60 to be locked to the mating connector 100 is provided substantially in a center of the arm body 40.

The lock claw 60 is provided in a front half of the entire length (i.e. dimension from the front end of the arm body 40 to the rear end of the unlocking portion 50) of the lock arm 30 and projects up from the arm body 40. A front part of the lock claw 60 is tapered to have an upper surface inclined down toward the front. The rear end of the lock claw 60 is a flat surface perpendicular to the upper surface of the arm body 40.

Figure 6:
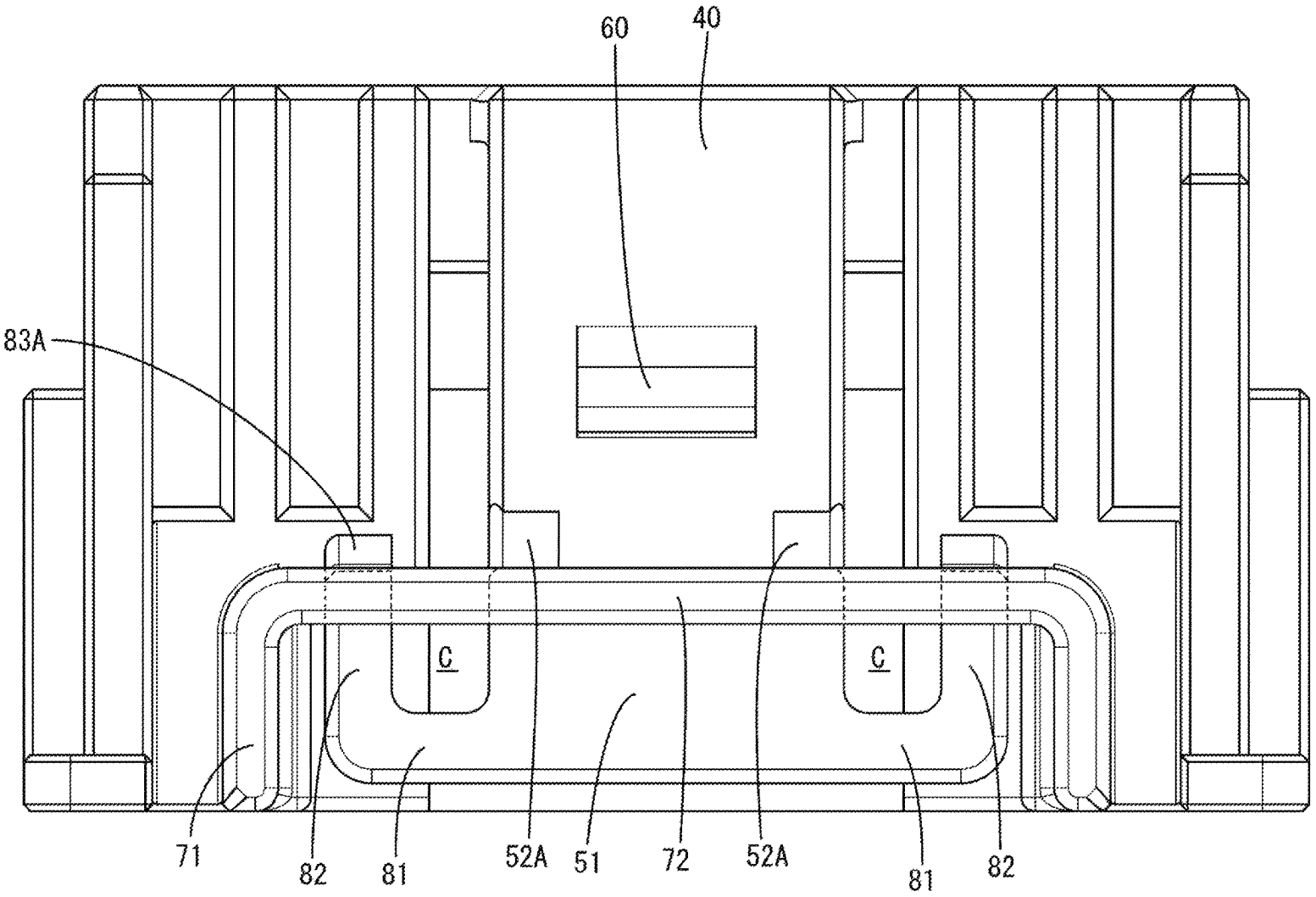
FIG. 6 is a top view of the connector.

The unlocking portion 50 has the same width as the arm body 40, as shown in FIG. 6, and extends farther rearward than the contacting tapered portion 40A while a front part is overlapping the contacting tapered portion 40A of the arm body 40 when viewed from above, as shown in FIG. 2. As shown in FIG. 3, the unlocking portion 50 includes left and right operating legs 52 and a receiving surface 51.

The operating leg walls 52 are coupled to both lateral end parts of the rear end of the arm body 40, extending in the front-rear direction and projecting up. The operating leg wall 52 has a first stress dispersing portion 52A formed into a tapered shape widened forward toward the bottom. This expands bottom areas of the operating leg walls 52 so that stress generated in the unlocking portion 50 is transferred in a dispersed manner from the operating leg walls 52 to the arm body 40.

A part of the operating leg wall 52 extending farther rearward than the contacting tapered portion 40A of the arm body 40 serves as a contact avoiding tapered portion 52B tapered to have a lower surface side inclined up toward the rear end, as shown in FIG. 2. The front end of the contact avoiding tapered portion 52B is connected to the rear end of the contacting tapered portion 40A. An angle of inclination of the contact avoiding tapered portion 52B with respect to the upper surface of the housing body 20 is larger than that of the contacting tapered portion 40A with respect to the upper surface of the housing body 20.

As shown in FIG. 6, the receiving surface 51 is a wide flat rectangular plate when viewed from above. As shown in FIG. 3, each lateral end of the receiving surface 51 is coupled to the projecting end of the corresponding operating leg wall 52.

(Legs 80)

As shown in FIG. 3, the legs 80 are bilaterally symmetrical with respect to each other in a top view. The legs 80 are disposed on both sides of the lock arm 30 and support the rear end of the lock arm 30 from opposite sides. Each leg 80 includes an interlocking support 81 having one end coupled to the rear of the lateral end of the unlocking portion 50 and extending laterally. An independent support 82 having a strip shape extends forward from an extending end of the interlocking support 81. A housing coupling 83 extends down from the front end of the independent support 82 and is coupled to the housing.

As shown in FIG. 4, the interlocking support 81 and the independent support 82 have a plate thickness equivalent to that of the receiving surface 51 of the unlocking portion 50. The upper surface of the interlocking support 81 and that of the independent support 82 are flat surfaces flush with the upper surface of the receiving surface 51. The front end of the independent support 82 is aligned substantially at the same position as the front end of the receiving surface 51. A width (dimension in the lateral direction) of the independent support 82 is equivalent to that of the independent support 81.

In other words, the receiving surface 51, the interlocking supports 81 and the independent supports 82 constitute one laterally long plate, and two cutout recesses C are formed by cutting the vicinities of both lateral ends of that plate from the front. A part between the cutout recesses C serves as the receiving surface 51, parts laterally separated from the receiving surface 51 across the cutout recesses C serve as the independent supports 82 and parts left without being cut behind the cutout recesses C serves as the interlocking supports 81.

As shown in FIG. 3, a second stress dispersing portion 83A is on a front side of the housing coupling 83 and has a tapered shape whose projecting height from the housing body 20 decreases toward the front. In this way, a bottom area of the housing coupling 83 is expanded and stress generated in the independent support 82 is transferred in a dispersed manner from the housing coupling 83 to the housing body 20.

As shown in FIGS. 4 and 6, the lock protecting portion 70 has two protecting walls 71 and one beam 72 that form a gate extending laterally to and above the lock arm 30 and the legs 80. The protection walls 71 are provided laterally outside the legs 80 and stand upright from the housing body 20. The beam 72 is a laterally extending bar and is coupled to upper parts of the front ends of the respective protection walls 71 on both ends thereof. This prevents external members and a worker from inadvertently touching the legs 80 and the unlocking portion 50 from above.

Next, movements of the lock arm 30 and the legs 80 in connecting and detaching the female connector 10 of this embodiment to and from the mating connector 100 are described with reference to FIGS. 7 to 10.

(During Connection)

When connecting the female connector 10 to the mating connector 100, the housing body 20 is inserted into the receptacle 110 of the mating connector 100 from the front.

Figure 7:
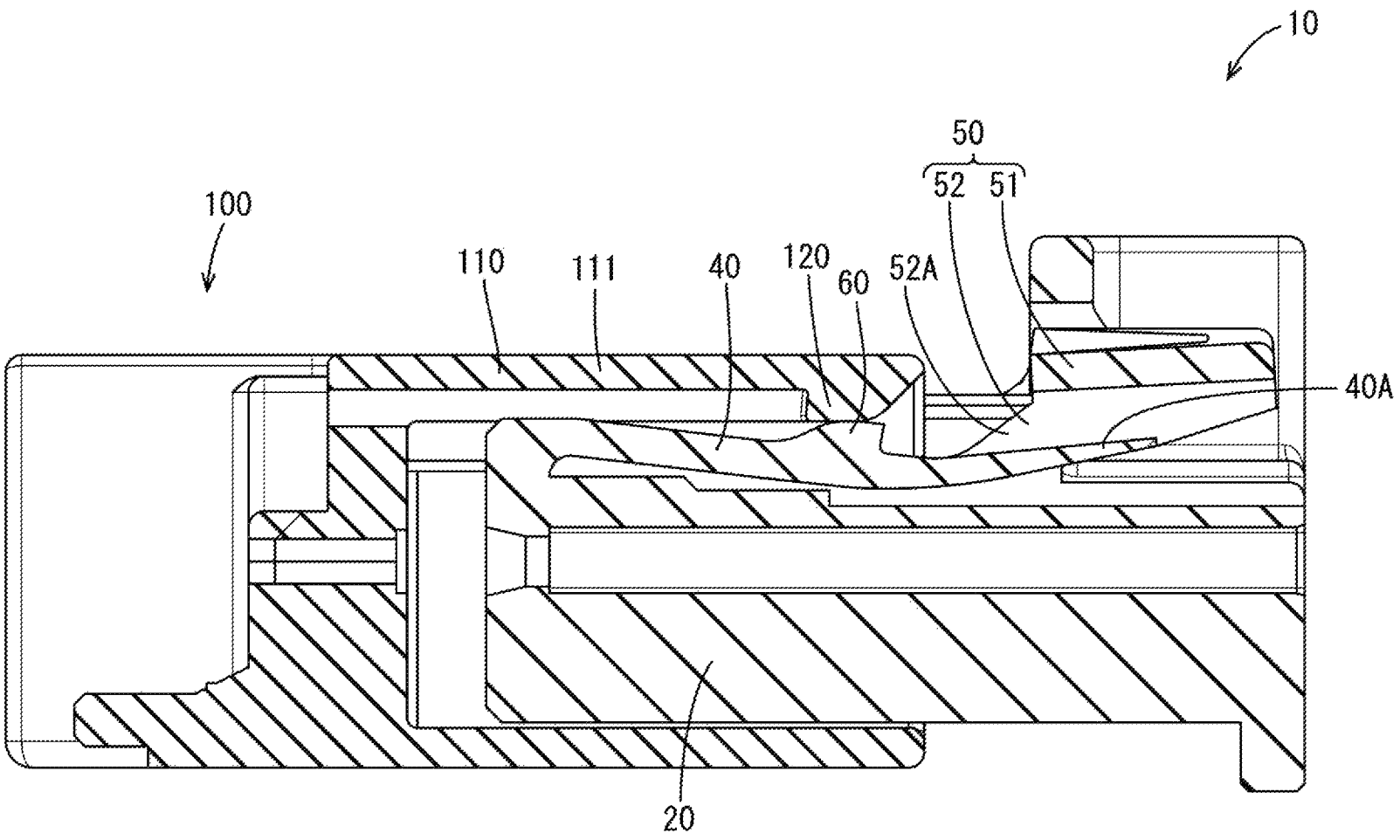
FIG. 7 is a longitudinal section of the connector in the process of connection to the mating connector.

Then, as shown in FIG. 7, the lock claw 60 contacts the lock receiving portion 120 of the mating connector 100 to be displaced down.

Figure 8:
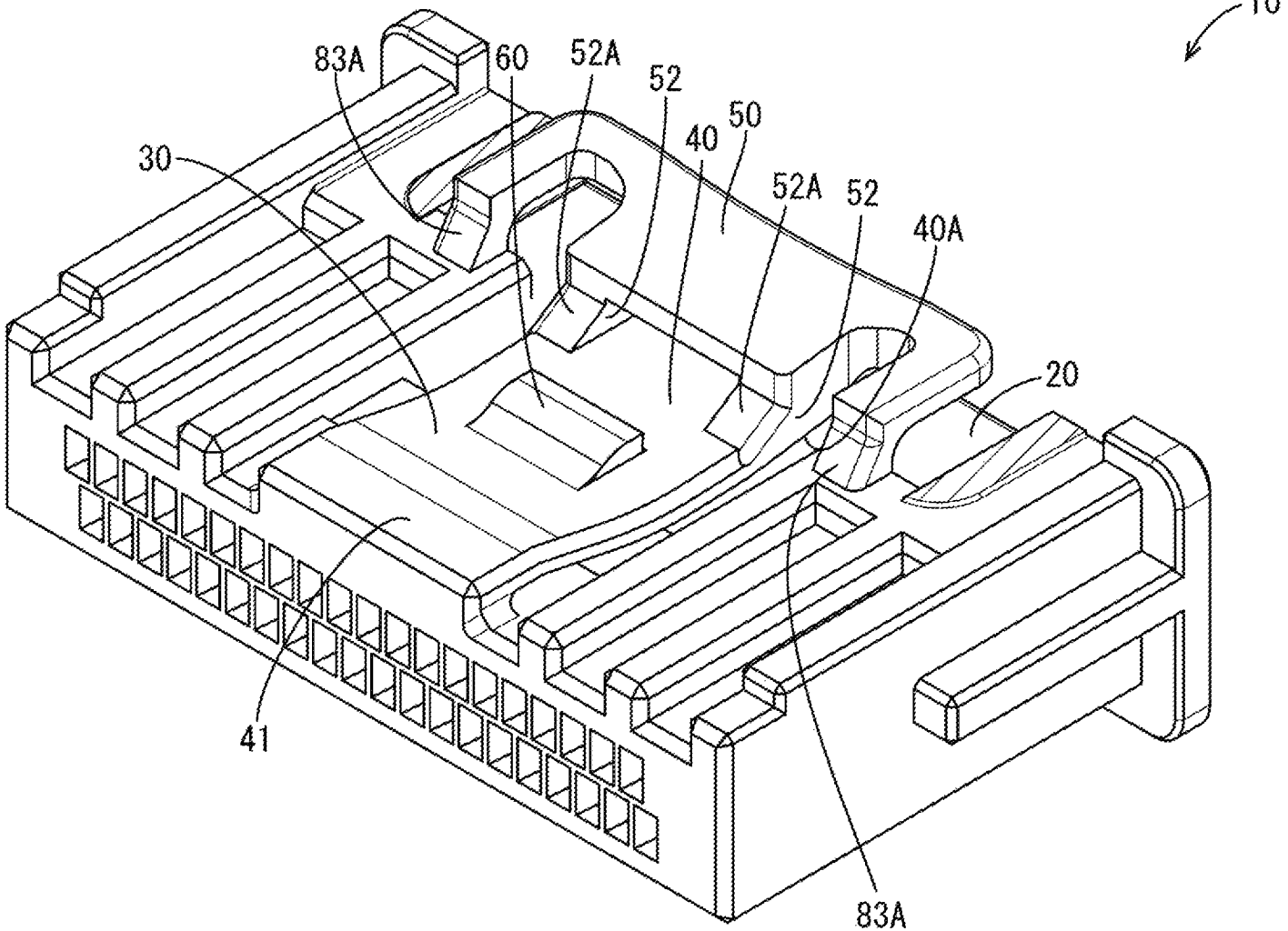
FIG. 8 is a perspective view of the connector in a state of FIG. 7.

The operating legs 52 of the unlocking portion 50 extend in the front-rear direction and rise on the contacting tapered portion 40A, which is a rear part of the arm body 40, as described above. In this way, the contacting tapered portion 40A is restricted from being deflected and deformed in the front-rear direction. Since this contacting tapered portion 40A is supported by the legs 80 via the unlocking portion 50, the arm body 40 is displaced down while being curved gently about the vicinities of base ends of the operating leg walls 52 (first stress dispersing portions 52A) substantially without displacing the rear end thereof and the unlocking portion 50, as shown in FIGS. 7 and 8. When the female connector 10 moves farther toward a back side of the receptacle 110 and the lock claw 60 moves over the lock receiving portion 120 and resiliently returns, a connected state is reached where the arm body 40 returns to a horizontal posture, the lock claw 60 and the lock receiving portion 120 are locked and the female connector 10 and the mating connector 100 are connected to each other, as shown in FIG. 2.

Note that since the lock arm 30 is supported on three points by the base end 41 and the two legs 80, the lock claw 60 resiliently returns with force toward the ceiling wall 111 of the receptacle 110 when the ceiling wall 60 is locked to the lock receiving portion 120. In this way, the worker can obtain a good locking feeling.

(During Unlocking)

On the other hand, in detaching the female connector 10 from the mating connector 100, the receiving surface 51 of the unlocking portion 50 is pressed down with a tool T, a finger or the like. Then, stress generated in the receiving surface 51 is transferred in a dispersed manner to the arm body 40 via the operating legs 52, and the entire arm body 40 from the rear end of the contacting tapered portion 40A to the base end 41 is displaced down together with the unlocking portion 50 with the base end 41 as a center as shown in FIG. 9.

The independent supports 82 that separate from the lock arm 30 extend horizontally rearward without being interlocked with a downward displacement of the lock arm 30. The receiving surface 51 is coupled to the independent supports 82 via the interlocking supports 81, the receiving surface 51 is displaced down while being deflected and deformed together with the interlocking supports 81, as shown in FIG. 10.

Figure 10:
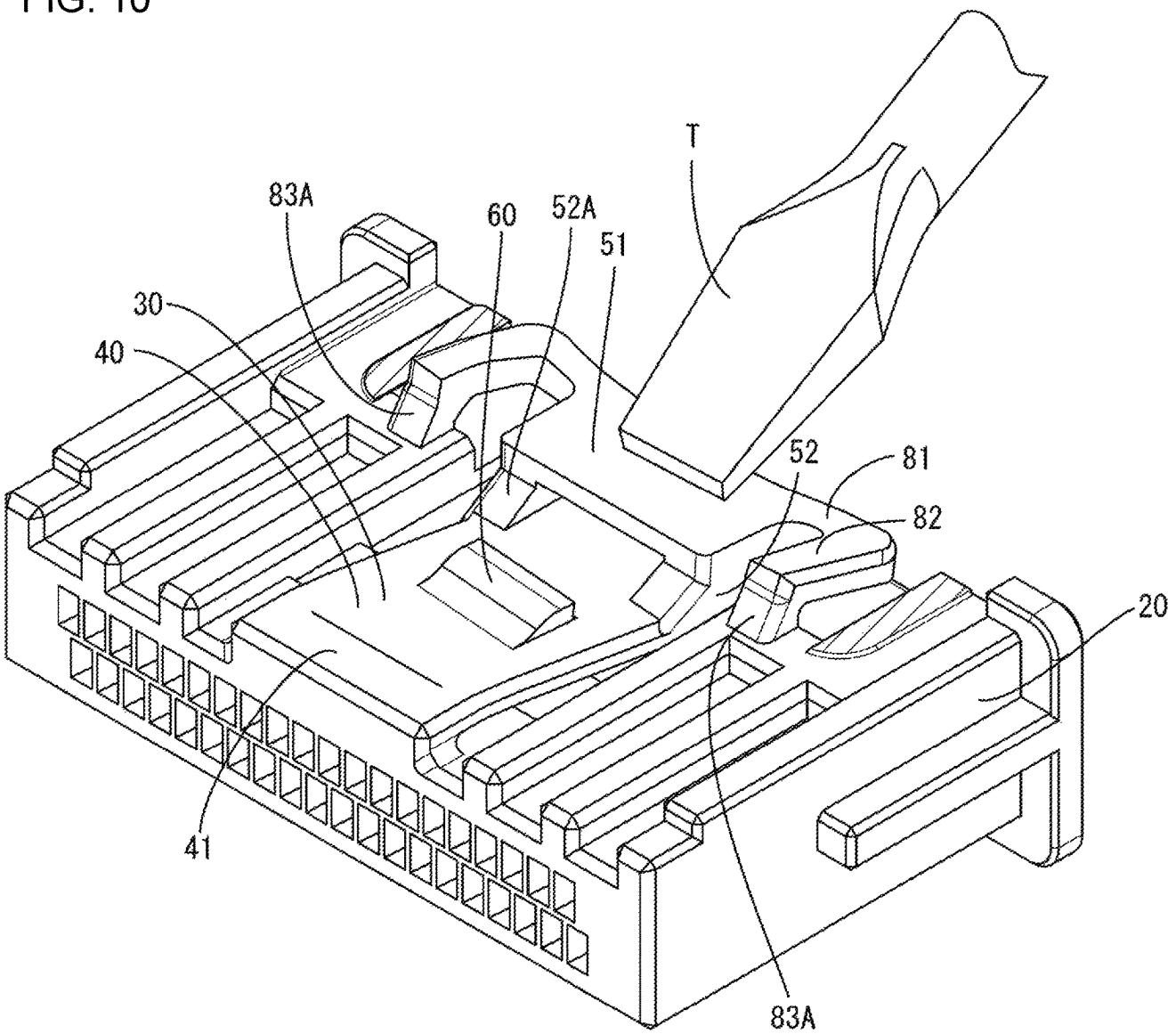
FIG. 10 is a perspective view of the connector in the state of FIG. 9.

Note that if stress generated in the receiving surface 51 by being pressed cannot be absorbed completely by the deformation of the interlocking supports 81 at this time, the independent supports 82 also displace somewhat down while being twisted toward the receiving surface 51 on the rear ends, as shown in FIG. 10. Displacements of the independent supports 82 are made smaller by as much as the stress is absorbed by the deflection and deformation of the interlocking supports 81.

Figure 9:
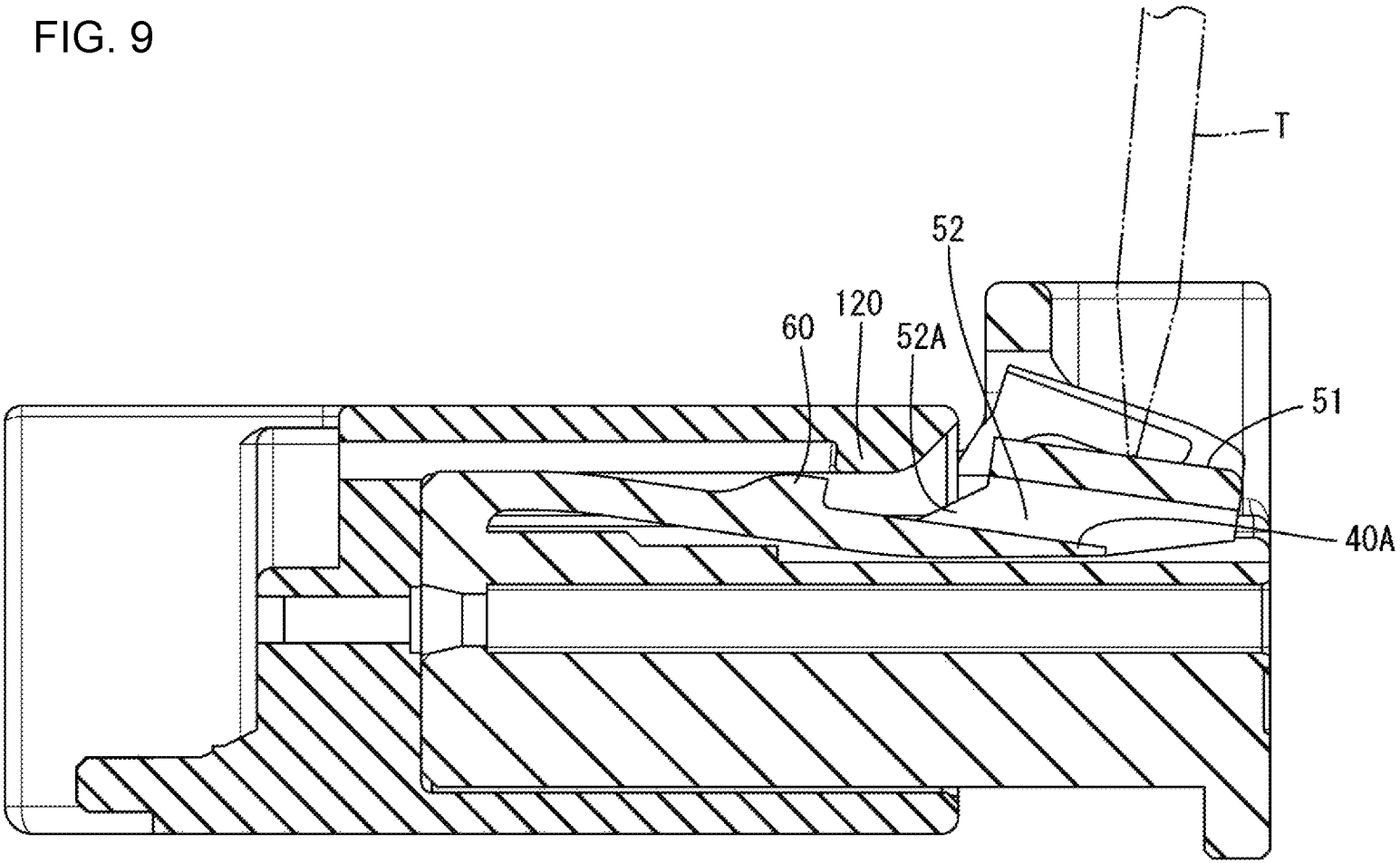
FIG. 9 is a longitudinal section in a state where a lock portion is unlocked.

By pulling out the female connector 10 rearward from the receptacle 110 when the lock claw 60 is displaced farther down than the lock receiving portion 120, as shown in FIG. 9, to complete detachment from the mating connector 100.

(Functions and Effects)

According to the configuration of this embodiment, the female connector 10 includes the housing body 20 to which the mating connector 100 is to be fit from the front. The lock arm 30 has the front end coupled to the housing body 20 and extending rearward, and the legs 80 laterally supporting the lock arm 30. The lock arm 30 includes the arm body 40 having the lock (lock claw 60) provided behind the base end 421 and to be locked to the mating connector 100 by resiliently returning up and the unlocking portion 50 coupled to the rear end of the arm body 40 and capable of displacing the arm body 40 down by being displaced down, and the leg 80 includes the interlocking support 81 laterally extending from the unlocking portion 50 above the housing body 20 and the independent support 82 separated from the lock arm 30 above the housing body 20, extending in the front-rear direction, and having one end coupled to the interlocking support 81 and the other end coupled to the housing body 20.

According to this configuration, the lock arm 30 can be supported on three points by the base end part 41 and the two legs 80 in locking the connector 10 to the mating connector 100, a locking force for the mating connector 100 can be ensured.

Further, when detaching the connector 10 from the mating connector 100, even if the unlocking portion 50 is displaced downward to displace the lock arm 30 down, the independent supports 82 are not interlocked with a downward displacement of the lock arm 30 since being separated from the lock arm 30. Thus, the lock arm 30 can be displaced down independently of the independent supports 82 while deflecting the interlocking supports 81. Specifically, since a pressing force for pressing and displacing the independent supports 82 down decreases, an unlocking force can be reduced.

Further, since being disposed above the housing body 20, the interlocking supports 81 contact the housing body 20 when being displaced down. In this way, excessive deflection of the lock arm 30 can be prevented.

The following configurations are preferable as embodiments relating to the technique disclosed in this specification.

The interlocking support portions 81 are coupled to the rear end of the unlocking portion 50 and the independent support portions 82 extend forward from the interlocking support portions 81.

According to this configuration, since the lock arm 30 is entirely within a three-point supporting range by the interlocking support portions 81 and the base end part 41 in a length direction, a locking force for the mating connector 100 can be ensured.

The cutout recesses C open forward or rearward are formed by the lock arm 30, the interlocking support portions 81 and the independent support portions 82.

According to this configuration, since the interlocking supports 81 are thinned by the cutout recesses C, the lock arm 30 is deflected easily when being displaced down. Specifically, since a deforming force for deflecting the interlocking supports 81 decreases, the unlocking force can be reduced.

<Second Embodiment>

Figure 11:
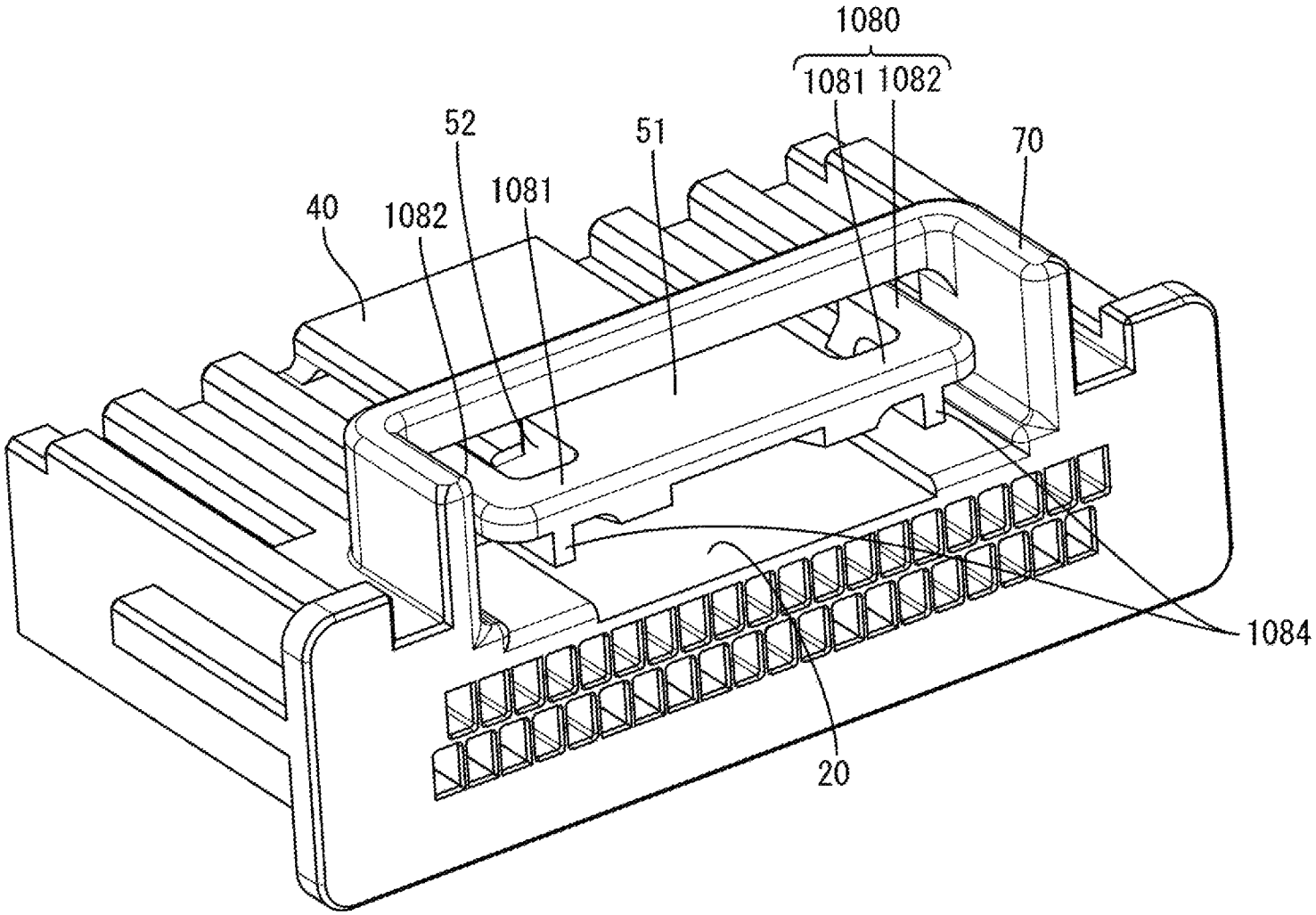
FIG. 11 is a perspective view of a second connector of a second embodiment viewed from behind.

Next, a second embodiment is described with reference to FIG. 11.

A connector 1010 of this embodiment is obtained by adding a pair of excessive deflection preventing ribs 1084 to the configuration of the connector 10 of the first embodiment, and components corresponding to those of the first embodiment are denoted by the reference signs of the first embodiment plus 1000. The same configuration, functions and effects as in the first embodiment are not described and the same components as in the above embodiment are denoted by the same reference signs.

The excessive deflection preventing ribs 1084 are in the form of ridges projecting downward from the lower surfaces of a pair of left and right interlocking support portions 81 and extending forward.

According to this configuration, downward excessive deflection of leg portions 1080 can be actively restricted.

<Other Embodiments>

This specification is not limited to the first and second embodiments described and illustrated above. For example, the technique can be embodied as follows.

Although the interlocking support portions 81 are coupled to the rear ends of the lateral ends of the unlocking portion 50 and the housing coupling portions 83 are provided in front of the interlocking support portions 81 in the above first and second embodiments, the interlocking support portions 81 may be coupled to the front ends of the both lateral sides of the unlocking portion 50 and the housing coupling portion 83 may be provided behind the interlocking supports 81.

Although the interlocking support portions 81 and the independent support portions 82 extend perpendicularly to each other in the above first and second embodiments, the interlocking support portions 81 and the independent support portions 82 may not be coupled perpendicularly to each other. In short, it is sufficient that the independent support portions 82 are separated from the lock arm 30 and coupled to the interlocking support portions 81 with interlocking with the interlocking support portions 81 restricted.

LIST OF REFERENCE SIGNS

10, 1010: female connector (connector)
20: housing body
30: lock arm
40: arm body
41: base end
50: unlocking portion
60: lock claw (lock portion)
80, 1080: leg
81: interlocking support
82: independent support
100: mating connector
1084: excessive deflection preventing rib
C: cutout recess

What is claimed is:

1. A connector, comprising:

a housing body extending in front to rear directions with a front end to which a mating connector is to be fit;

a lock arm having an arm body with a base end coupled to the housing body and the arm body extending rearward from the base end, a lock provided behind the base end and to be locked to the mating connector by resiliently returning upward, and an unlocking portion coupled to a rear end of the arm body and capable of displacing the arm body down by being displaced down; and two legs each having a coupling projecting from the housing body on opposite lateral sides of the lock arm and coupled to the unlocking portion, independent supports extending rearward from the couplings and separated from the lock arm above the housing body, and interlocking supports projecting from the independent supports in directions towards each other and into connection with the unlocking portion.

2. The connector of claim 1, wherein cutout recesses open forward or rearward are formed by the lock arm, the interlocking supports and the independent supports.

3. The connector claim 1, wherein first and second cutout recesses are formed between the unlocking portion and each of the independent supports and extend forward from the interlocking supports.

* * * * *